US011744337B2

(12) United States Patent
He

(10) Patent No.: US 11,744,337 B2
(45) Date of Patent: Sep. 5, 2023

(54) CANTILEVER PARASOL

(71) Applicant: Jianfeng He, Zhejiang (CN)

(72) Inventor: Jianfeng He, Zhejiang (CN)

(73) Assignee: Zhejiang Chenxin Outdoor Products Co., Ltd., Taizhou (CN)

( * ) Notice: Subject to any disclaimer, the term of this patent is extended or adjusted under 35 U.S.C. 154(b) by 233 days.

(21) Appl. No.: 17/399,085

(22) Filed: Aug. 11, 2021

(65) Prior Publication Data

US 2022/0279904 A1 Sep. 8, 2022

(30) Foreign Application Priority Data

Jun. 9, 2021 (CN) ..... 202110644587.X

(51) Int. Cl.
*A45B 25/14* (2006.01)
*A45B 23/00* (2006.01)

(52) U.S. Cl.
CPC ..... *A45B 25/14* (2013.01); *A45B 23/00* (2013.01); *A45B 2023/0012* (2013.01); *A45B 2023/0037* (2013.01); *A45B 2025/146* (2013.01)

(58) Field of Classification Search
CPC ..... A45B 2025/146; A45B 2023/0037; A45B 25/14
See application file for complete search history.

(56) References Cited

U.S. PATENT DOCUMENTS 5,735,302 A 4/1998 Saliva
9,220,325 B2 12/2015 Ma
10,426,236 B1 * 10/2019 Huckvale ..... A45B 25/18
10,932,536 B2 * 3/2021 Kong ..... A45B 17/00
2004/0069333 A1 4/2004 Ma
2009/0095336 A1 4/2009 Glatz
2010/0051074 A1 * 3/2010 Dan ..... A45B 23/00 135/20.3
2010/0212705 A1 * 8/2010 Tung ..... A45B 23/00 135/20.1

(Continued)

FOREIGN PATENT DOCUMENTS

CN 201079087 Y 7/2008
CN 201585528 U 9/2010

(Continued)

*Primary Examiner* — Noah Chandler Hawk

(74) *Attorney, Agent, or Firm* — Minder Law Group; Willy H. Wong

(57) ABSTRACT

The invention discloses a cantilever parasol with reduced maintenance workload. When the reel mechanism requires maintenance, one only needs to detach the reel housing from the inclined rod, without a need to perform a separate disassembly operation to the cord spool assembly or a need to change a connection relationship between the inclined rod and the post, avoiding difficulty in re-assembling the inclined rod.

The cantilever parasol includes a post, an inclined rod and a reel mechanism. The reel mechanism includes a reel housing is detachably connected with the inclined rod, and a cord spool assembly is rotatably installed in the reel housing and located on an outer side of the inclined rod. One end of the inclined rod is connected with the post, the inclined rod is provided with a cord hole, and a cord is passed through the cord hole and connected with the cord spool assembly.

9 Claims, 9 Drawing Sheets

(56) References Cited

U.S. PATENT DOCUMENTS

| | | | | |
|---|---|---|---|---|
| 2011/0005558 | A1* | 1/2011 | Lai | A45B 17/00 135/20.1 |
| 2015/0068566 | A1 | 3/2015 | Ma | |
| 2015/0068567 | A1 | 3/2015 | Ma | |
| 2015/0075574 | A1 | 3/2015 | Ma | |
| 2016/0183647 | A1 | 6/2016 | Ma | |
| 2022/0079308 | A1* | 3/2022 | Xie | A45B 25/14 |

FOREIGN PATENT DOCUMENTS

| | | | | |
|---|---|---|---|---|
| CN | 201814004 | U | 5/2011 | |
| CN | 202286686 | U | 7/2012 | |
| EP | 2103230 | A1 * | 9/2009 | A45B 23/00 |

* cited by examiner

CANTILEVER PARASOL

RELATED APPLICATIONS

This application claims priority to Chinese Patent Application No. CN202110644587.X, filed Jun. 9, 2021.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

TECHNICAL FIELD

The present invention pertains to the technical field of cantilever parasols.

BACKGROUND

Cantilever parasols, as a kind of outdoor leisure appliances, are widely used in squares, beaches, parks, courtyards and other leisure places, providing people with comfortable cooling spaces.

A cantilever parasol, for example, is disclosed in Chinese patent No. CN201585528U. The cantilever parasol comprises a post, an inclined rod, a tie rod, parasol ribs, a positioning mechanism and a reel mechanism, one end of the tie rod being connected to a top portion of the post, the other end of the tie rod being mounted onto the parasol ribs, the positioning mechanism being provided on the post, the reel mechanism being provided on the inclined rod, one end of the reel mechanism being connected to the positioning mechanism, the other end of the reel mechanism being connected to the parasol ribs through the inclined rod, the reel mechanism being capable of controlling opening and closing of the parasol ribs. Because the inclined rod and the positioning mechanism are connected together by the reel mechanism, when the reel mechanism fails and requires maintenance, the reel mechanism needs to be disassembled from between the inclined rod and the positioning mechanism, and after disassembling the reel mechanism, the inclined rod cannot be supported by the post and thus is in a natural hanging state under action of gravity, and then, after completion of maintenance of the reel mechanism, the inclined rod needs to be supported upwards before the reel mechanism can be reinstalled between the positioning mechanism and the inclined rod. In addition, a reel shaft of the reel mechanism is provided to be inserted in the inclined rod, thus, when disassembling the reel mechanism, components of the reel shaft need to be disassembled, and the whole reel shaft needs to be withdrawn from the inclined rod, making disassembly inconvenient. The cantilever parasol is formed after installation of a parasol canopy onto the inclined rod and the parasol ribs. The above cantilever parasol can control opening and closing of the parasol ribs by means of the reel mechanism, making the cantilever parasol convenient to use, but it still has shortcomings: when the reel mechanism fails and requires maintenance, workload for disassembling and reinstalling is heavy, making maintenance inconvenient.

SUMMARY

Some objectives of one embodiment of the present invention are to provide a cantilever parasol with respect to the above defects in the prior art, to solve the technical problem of how to improve convenience of maintenance of a reel mechanism of a cantilever parasol.

The objectives of the present invention can be achieved by the following technical solution.

In one embodiment of a cantilever parasol, comprising a post and a reel mechanism and an inclined rod capable of supporting parasol ribs, the inclined rod being hollow and allowing a cord to extend along its inner channel, the reel mechanism comprising a reel housing and a cord spool assembly capable of controlling winding and unwinding of the cord, wherein a side wall of the reel housing is provided with an avoidance notch communicated with an inner cavity of the reel housing, one end of the inclined rod is connected with the post, an outer peripheral surface of the inclined rod is provided with a cord hole communicated with the inner channel of the inclined rod, a side portion of the inclined rod is embedded in the avoidance notch, a part of the inclined rod provided with the cord hole is located in the inner cavity of the reel housing, the reel housing and the inclined rod are detachably connected with each other, the cord spool assembly is rotatably installed in the reel housing and located on an outer side of the inclined rod, and the cord is passed through the cord hole and connected with the cord spool assembly.

In one embodiment of the above cantilever parasol, the reel housing comprises a first half housing and a second half housing that are detachably connected, the cord spool assembly is located between the first half housing and the second half housing, the first half housing and the second half housing are snap-fitted together to form the avoidance notch, and the first half housing and the second half housing are respectively detachably connected to two sides of the inclined rod.

In one embodiment of the above cantilever parasol, the cord spool assembly comprises a cord spool capable of winding the cord, a rotatable cord guide roller is provided in and connected to the inner channel of the inclined rod, an axial line of the cord guide roller is parallel to an axial line of the cord spool, and the cord hole is located between the cord guide roller and the cord spool.

In one embodiment of the above cantilever parasol, the post comprises a vertically disposed pole and an adjusting mount capable of sliding upward and downward along the pole and positioning on the pole, one end of the inclined rod is hinged to the adjusting mount, and the inclined rod is capable of swinging upward and downward relative to the adjusting mount.

In one embodiment of the above cantilever parasol, one end portion at one end of the inclined rod is sleeved into a sleeve shell, and the sleeve shell, the inclined rod and the adjusting mount are coaxially hinged. The sleeve shell can wrap sharp edges of the end of the inclined rod, forming a protection for the end of the inclined rod and the adjusting mount. Both the sleeve shell and the inclined rod are coaxially hinged with the adjusting mount. Thus, the inclined rod, the sleeve shell and the adjusting mount can be connected by a same articulating shaft, reducing influence of assembly tolerances on stability, thereby reducing possibility of swaying of the inclined rod, and making installation of the inclined rod stable.

In one embodiment of the above cantilever parasol, a rim of the avoidance notch is provided with a flange capable of limiting the inclined rod from falling out of the avoidance notch, and the flange protrudes toward an inner side of the avoidance notch.

In one embodiment of the above cantilever parasol, the first half housing has a first rotating groove and the second half housing has a second rotating groove, the two rotating grooves are coaxially and directly facing each other, and two ends of the cord spool assembly are respectively rotatably fitted in the two rotating grooves.

In one embodiment of the above cantilever parasol, the cord spool assembly further comprises a reel shaft capable of driving the cord spool to rotate, the cord spool is coaxially sleeved onto the reel shaft, a bottom of the first rotating groove on the first half housing is provided with a through hole penetrating through a housing wall of the first half housing, the through hole and the first rotating groove are arranged coaxially, and one end of the reel shaft is inserted into the through hole.

In one embodiment of the above cantilever parasol, one end of the reel shaft inserted into the through hole is sleeved into a metal bushing, and the metal bushing is embedded in the through hole.

In one embodiment of the above cantilever parasol, two tie rods are hinged between the inclined rod and the post, first ends of the two tie rods are respectively located on two sides of a top end of the post, and second ends of the two tie rods are respectively located on two sides of a middle section of the inclined rod.

Compared to the prior art, the present invention has the following advantages: For the cantilever parasol of the present invention, when the reel mechanism fails and requires maintenance, one only needs to detach the reel housing from the inclined rod, without a need to perform a separate disassembly operation to the cord spool assembly or a need to change a connection relationship between the inclined rod and the post, avoiding difficulty in re-assembling the inclined rod under action of a torque of the inclined rod, greatly reducing workload and difficulty in disassembling/reinstalling the reel mechanism during/after maintenance, and improving convenience of maintenance of the reel mechanism.

DETAILED DESCRIPTION

Set forth below are specific embodiments of the present invention and a further description of the technical solutions of the present invention in conjunction with the accompanying drawings, but the present invention is not limited to these embodiments.

Figure 1:
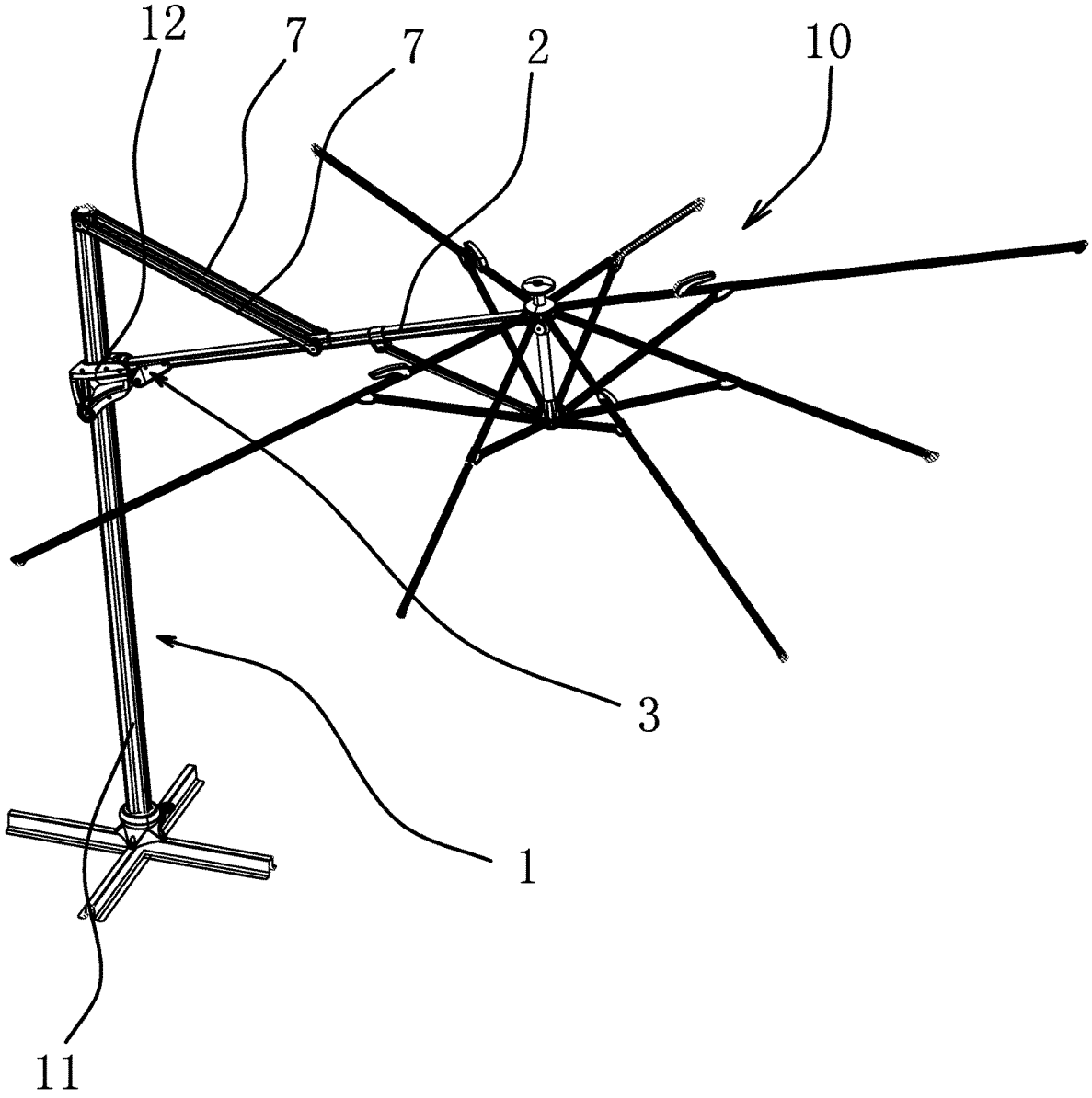
FIG. 1 is a perspective view of one embodiment of a parasol frame of a cantilever parasol of the present invention.
Figure 2:
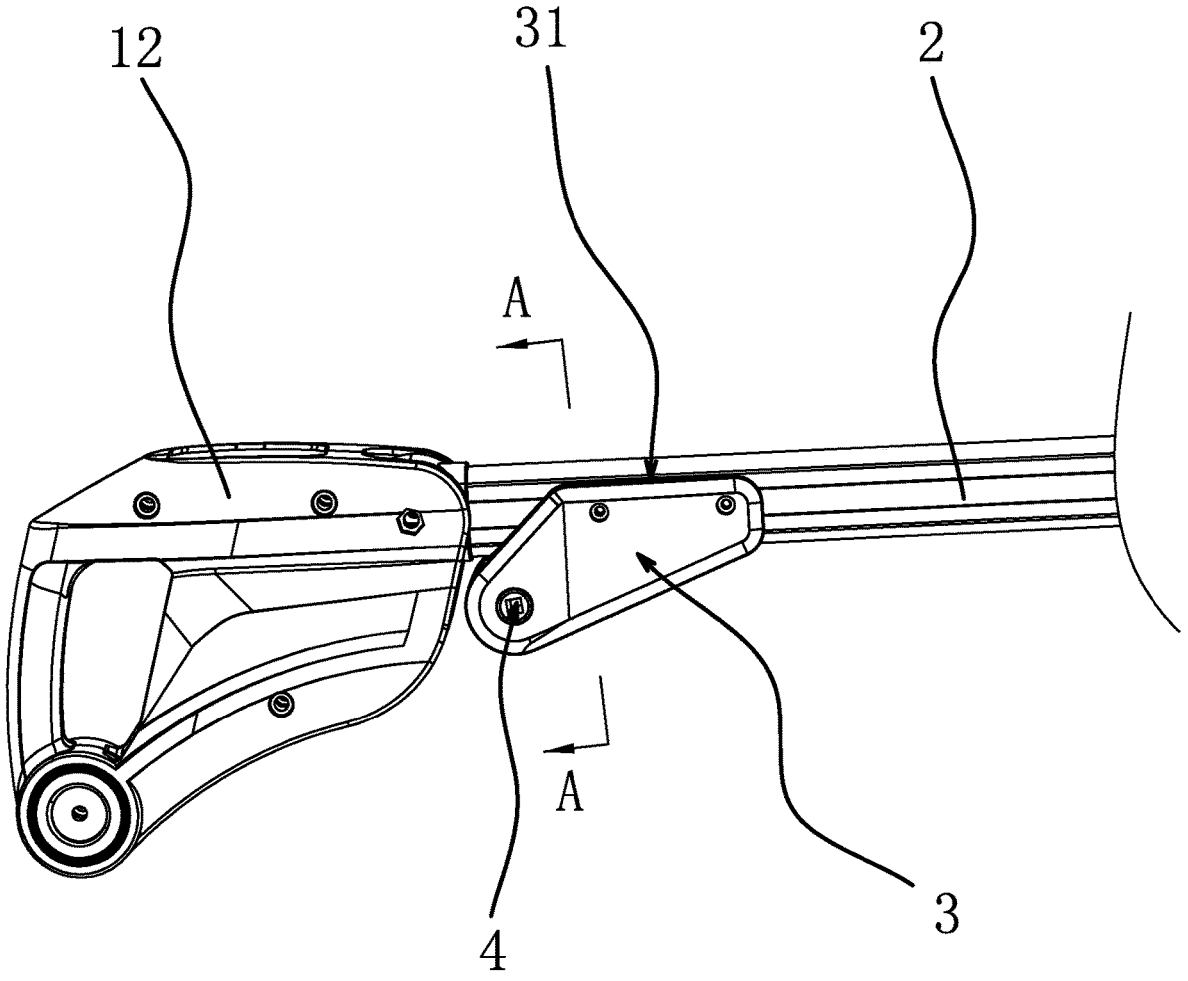
FIG. 2 is a partial perspective view of one embodiment of a reel housing, an inclined rod, and an adjusting mount of the present invention.
Figure 3:
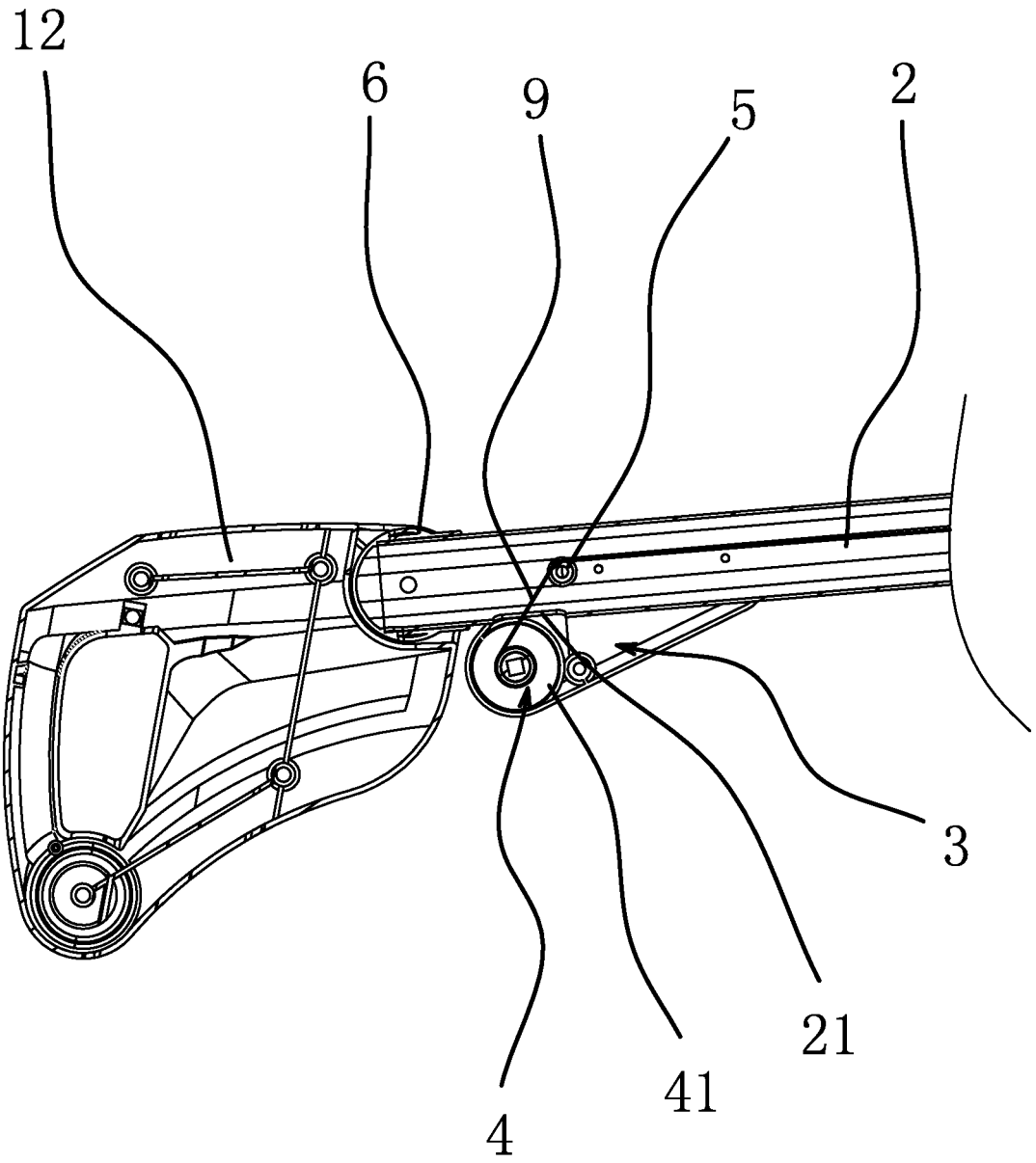
FIG. 3 is a partial cross-sectional perspective view of one embodiment of a reel housing, an inclined rod, and an adjusting mount of the present invention.
Figure 4:
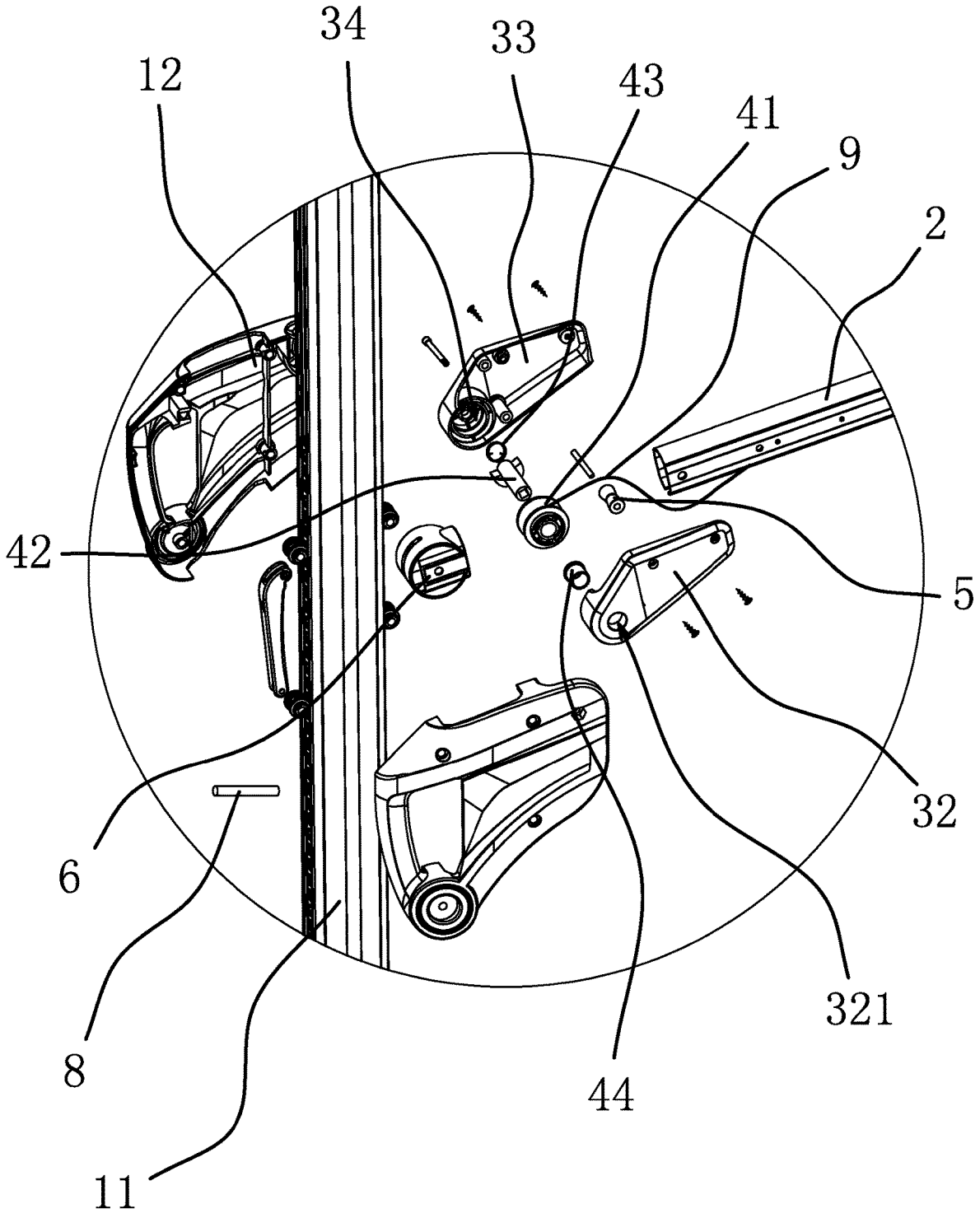
FIG. 4 is an exploded perspective view of a part of one embodiment of a parasol frame of a cantilever parasol of the present invention.
Figure 5:
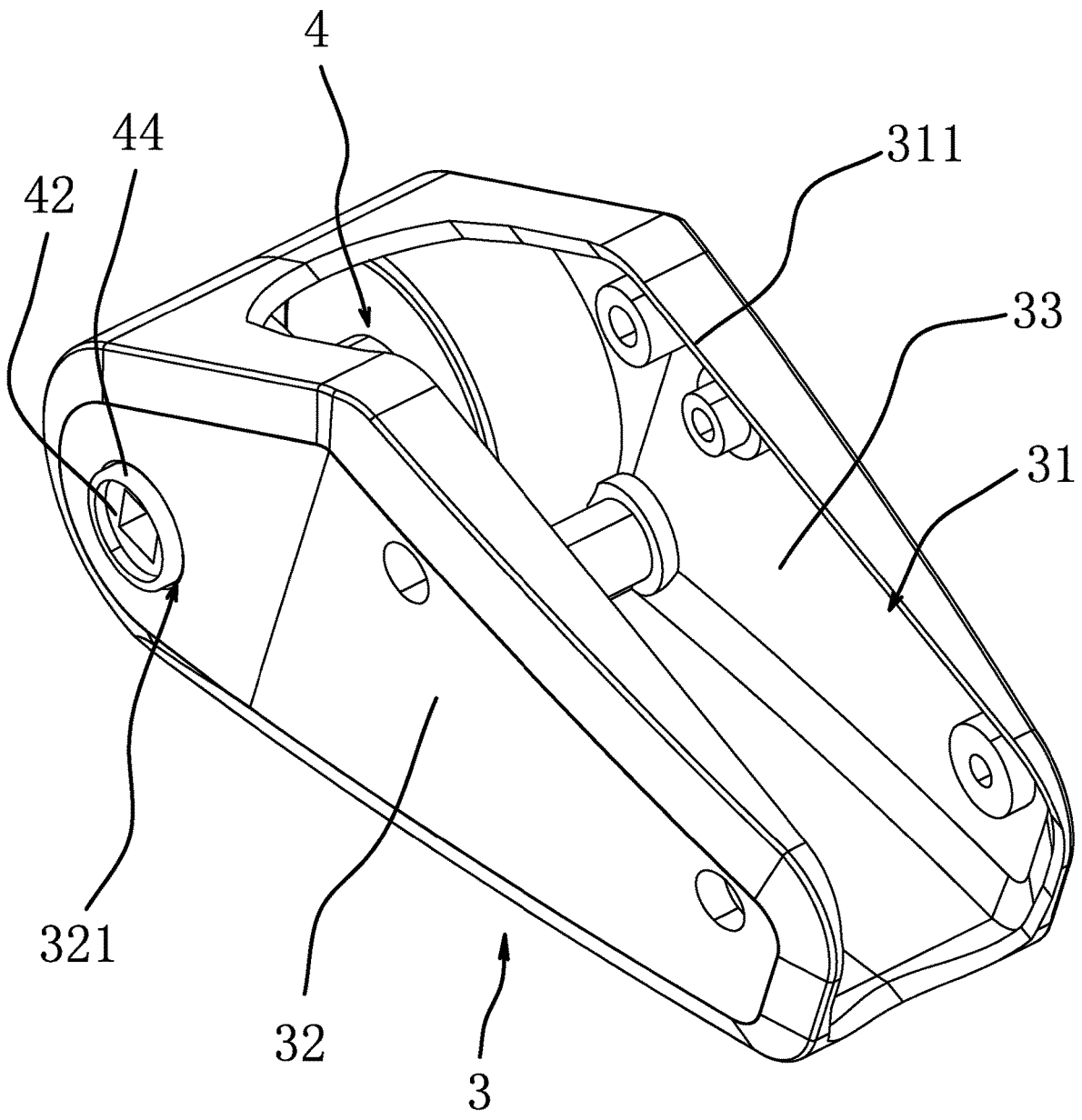
FIG. 5 is a perspective view of one embodiment of a reel housing and a cord spool assembly of the present invention.
Figure 6:
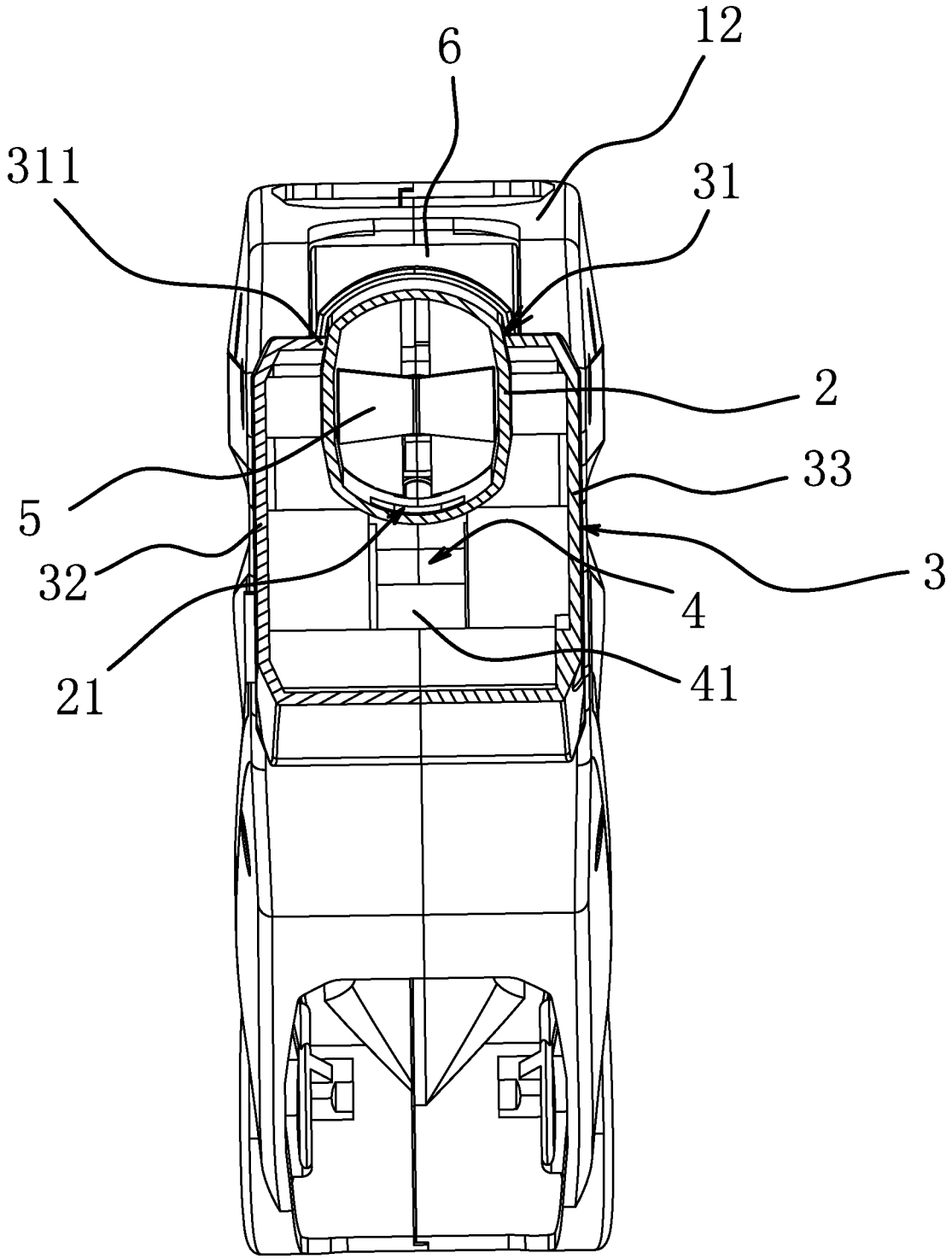
FIG. 6 is a cross-sectional perspective view along an A-A direction shown in FIG. 2.
Figure 7:
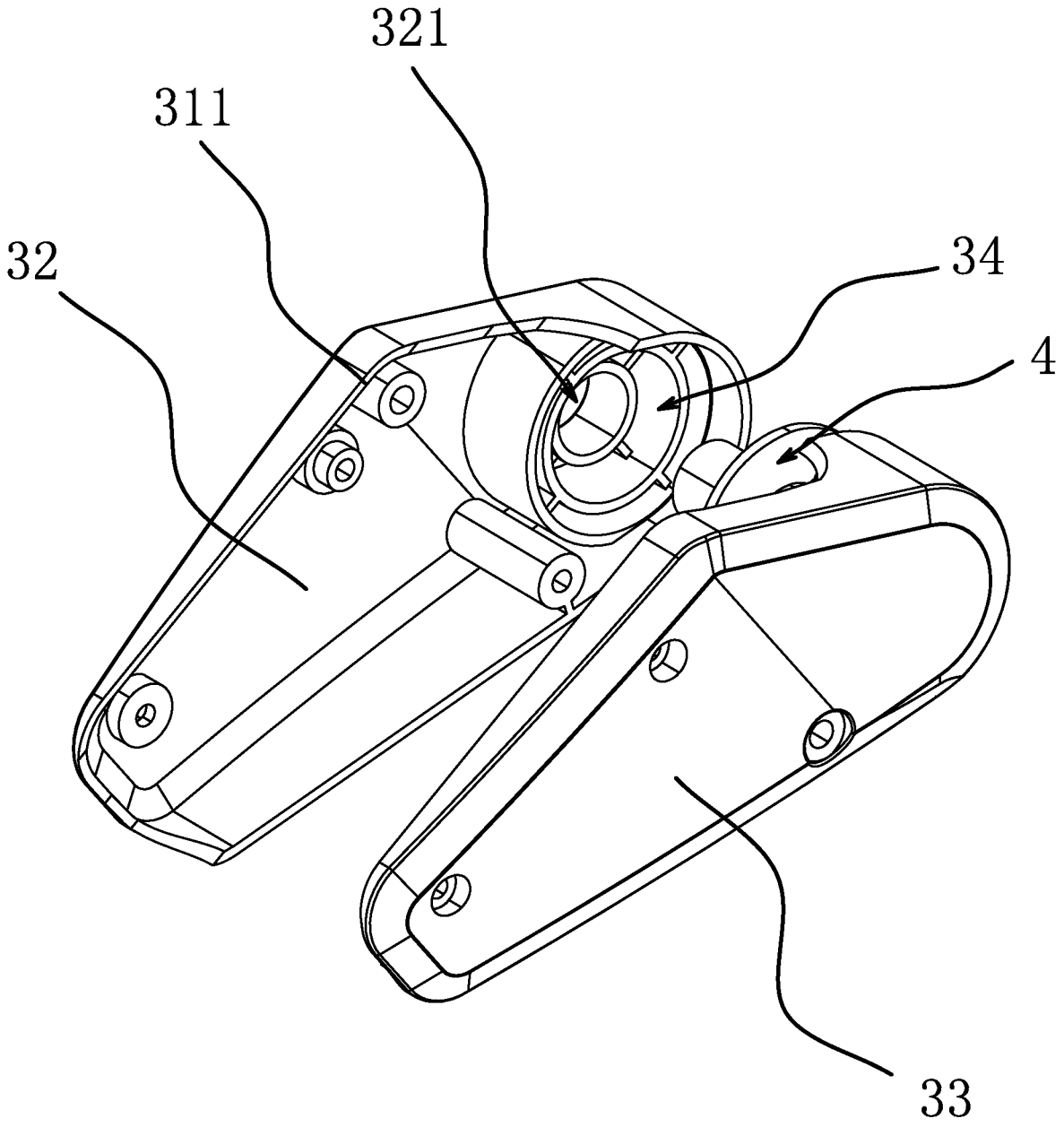
FIG. 7 is an exploded perspective view of one embodiment of a reel housing and a cord spool assembly of the present invention.
Figure 8:
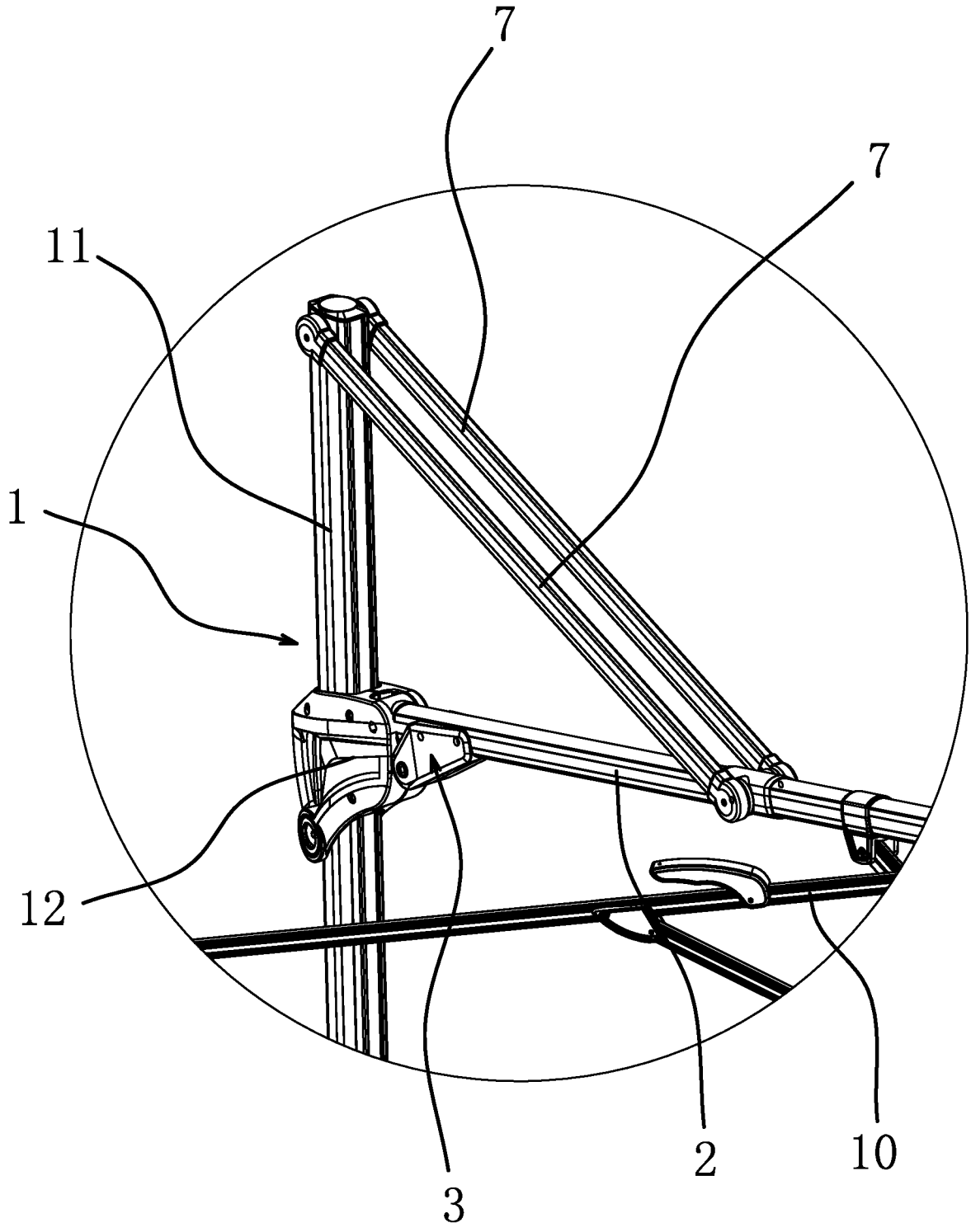
FIG. 8 is a perspective view of a part of one embodiment of a parasol frame of a cantilever parasol of the present invention.
Figure 9:
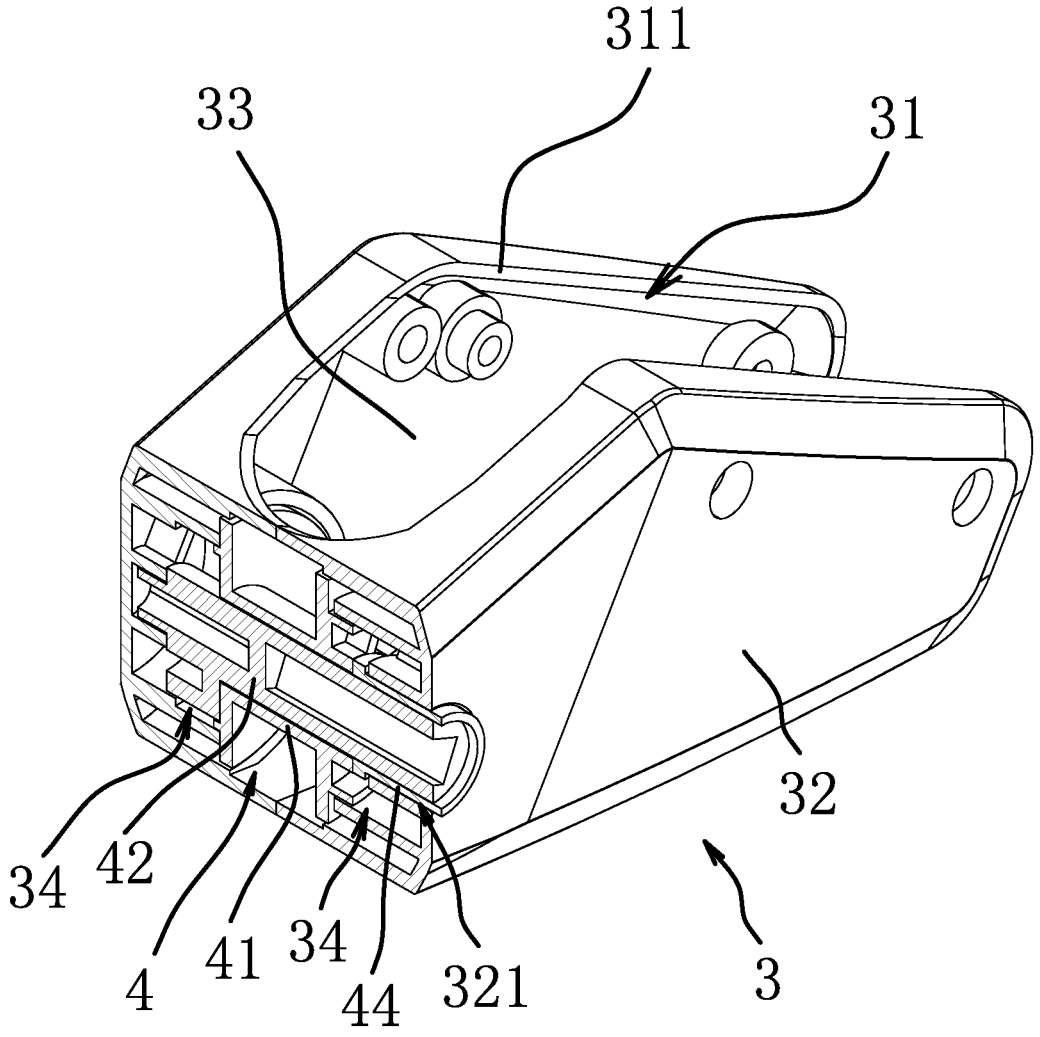
FIG. 9 is a cross-sectional perspective view of one embodiment of a reel housing and a cord spool assembly of the present invention.

As shown in FIGS. 1-9, one embodiment of a cantilever parasol of the present invention comprises a post 1 and a reel mechanism and an inclined rod 2 capable of supporting parasol ribs 10 and a parasol canopy, the inclined rod 2 being in form of a hollow tube and allowing a cord 9 to extend along its inner channel. The parasol canopy is mount onto the parasol ribs 10, and a frame of the cantilever parasol when the parasol canopy is not mounted is termed as a parasol frame. The reel mechanism comprises a reel housing 3 and a cord spool assembly 4 capable of controlling winding and unwinding of the cord 9, the reel housing 3 being detachably connected onto the inclined rod 2. An upper surface of the reel housing 3 is provided with an avoidance notch 31 communicated with an inner cavity of the reel housing 3, one end of the inclined rod 2 is connected with the post 1, a lower surface of the inclined rod 2 is provided with a cord hole 21 communicated with the inner channel of the inclined rod 2, a side portion of the inclined rod 2 is embedded in the avoidance notch 31, a part of the inclined rod 2 provided with the cord hole 21 is located in the inner cavity of the reel housing 3. The inclined rod 2 and the reel housing 3 are detachably connected with each other by screws or bolts. The cord hole 21 is communicated with the inner cavity of the reel housing 3, the cord spool assembly 4 is disposed between and rotatably connected to side walls of the inner cavity of the reel housing 3 and located on an outer side of the inclined rod 2, one end of the cord 9 is passed through the cord hole 21 and connected with the cord spool assembly 4, while the other end of the cord 9 is connected with the parasol ribs 10.

The post 1 of the cantilever parasol is used to provide support for the whole parasol frame, the hollow inclined rod 2 is used to support the overhanging parasol ribs 10 and the parasol canopy, and the inner channel of the inclined rod 2 allows the cord 9 to extend along it to control opening and closing of the parasol ribs 10; the cord spool assembly 4 of the reel mechanism can be driven to rotate to cause winding, unwinding and locking of the cord 9, thus achieving convenient control of opening and closing of the parasol canopy, while the reel housing 3 functions to provide a mounting space, decoration and protection for the cord spool assembly 4. When the reel mechanism is in use, the reel housing 3 is secured onto the inclined rod 2, and the cord spool assembly 4 is rotated to wind/unwind the cord 9, so that the wound/unwound segment of the cord 9 exits from/enters into the inner channel of the inclined rod 2 through the cord hole 21, thus realizing control of the cord 9 by means of the cord spool assembly 4. When the reel mechanism needs to be maintained, the reel housing 3 can be detached from the inclined rod 2 directly, and because the cord spool assembly 4 is installed in the reel housing 3 and located on an outer side of the inclined rod 2, in other words, the cord spool assembly 4 is connected only to the reel housing 3, and not to the inclined rod 2, disassembling the reel housing 3 does not require a separate disassembly operation to the cord spool assembly 4. Moreover, because the inclined rod 2 is connected to the post 1 directly, instead of being connected to the post 1 through the reel mechanism, this connection relationship between the inclined rod 2 and the post 1 does not need to be changed in the process of detaching the reel mechanism from the inclined rod 2 for the purpose of maintenance, avoiding difficulty in re-assembling the inclined rod 2 under action of a torque of the inclined rod 2, after disassembly of the inclined rod 2, and thus greatly reducing workload and difficulty in disassembling/reinstalling the reel mechanism during/after maintenance. Therefore, the cantilever parasol of the present invention improves convenience of maintenance of the reel mechanism, without affecting the reel mechanism's capability of controlling winding and unwinding of the cord 9.

Further, the reel housing 3 comprises a first half housing 32 and a second half housing 33 that are detachably connected, the first half housing 32 and the second half housing 33 being secured by screws when the reel housing 3 is in use. The cord spool assembly 4 is located between the first half housing 32 and the second half housing 33, the first half housing 32 and the second half housing 33 are snap-fitted together to form the avoidance notch 31, and the first half housing 32 and the second half housing 33 are respectively detachably connected to two sides of the inclined rod 2. The first half housing 32 and the second half housing 33 are respectively fixedly connected to two sides of the inclined rod 2 by screws. This allows the first half housing 32 or the second half housing 33 to be disassembled separately when there is a problem only with the cord spool assembly 4, so as to expose the whole cord spool assembly 4 for maintenance, thus greatly improving convenience of maintenance of the reel mechanism.

The cord spool assembly 4 comprises a cord spool 41 capable of winding the cord 9, a cord guide roller 5 is provided in and rotatably connected to the inner channel of the inclined rod 2, the two ends of the cord guide roller 5 are respectively inserted into the side walls of the inclined rod 2, an axial line of the cord guide roller 5 is parallel to an axial line of the cord spool 41, and the cord hole 21 is located between the cord guide roller 5 and the cord spool 41. The cord 9 extending between the cord guide roller 5 and the cord spool 41 is kept clear of a side wall of an inner rim of the cord hole 21. By providing the cord guide roller 5 rotatably connected to a side wall of the inner channel of the inclined rod 2, and putting the cord 9 to rest in a groove of the cord guide roller 5, the cord 9 thus is guided in the inner channel of the inclined rod 2, by the cord guide roller 5, to align with a length direction of the inclined rod 2; further, an axial line of the cord guide roller 5 is parallel to an axial line of the cord spool 41, and the cord hole 21 is located between the cord guide roller 5 and the cord spool 41, thus the cord 9 passing through the cord hole 21 is guided by cooperation of the cord guide roller 5 and the cord spool 41, and the cord 9 is kept clear of the inner rim of the cord hole 21, which is conducive to reducing probability of contact friction between the cord 9 and the inner rim of the cord hole 21, thereby ensuring that the cord 9 wound/unwound by the cord spool assembly 4 may pass through the cord hole 21 smoothly and avoid frictional interference between the cord 9 and a rim of the cord hole 21, making winding/unwinding smoothly and reducing failure rate.

Preferably, a rim of the avoidance notch 31 is provided with a flange 311 capable of limiting the inclined rod 2 from falling out of the avoidance notch 31, and the flange 311 protrudes toward an inner side of the avoidance notch 31. Side walls on both sides of a section of the inclined rod 2 project outward to form convex side portions, the convex side portions are located in the inner cavity of the reel housing 3, and the convex side portions are limited by the flange 311. By providing the flange 311 projecting toward the inner side of the avoidance notch 31 at an edge of the notch 31, the flange 311 cooperates with an outer peripheral surface of the inclined rod 2 to limit the inclined rod 2 from falling out of the avoidance notch 31, thus enhancing stability of a connection between the reel housing 3 and the inclined rod 2 when in use, and at the same time playing a positioning role when assembling the first half housing 32 and the second half housing 33, thereby improving convenience of installation and convenience of maintenance.

The first half housing 32 has a first rotating groove 34 on an inner lateral surface of the first half housing 32, and the second half housing 33 has a second rotating groove 34 on an inner lateral surface of the second half housing 33, the two rotating grooves 34 are cylinder-shaped recessed grooves and coaxially and directly facing each other, and two ends of the cord spool assembly 4 are respectively rotatably fitted in the two rotating grooves 34. A bottom of the rotating groove 34 on the first half housing 32 is provided with a through hole 321 penetrating through a housing wall of the first half housing 32, and a bottom of the rotating groove 34 on the second half housing 33 is provided with a blind hole, both the through hole 321 and the blind hole are cylindrical holes, and the through hole 321 and the blind hole are arranged coaxially with the two rotating grooves 34. The cord spool assembly 4 further comprises a reel shaft 42 capable of driving the cord spool 41 to rotate, the cord spool 41 is coaxially connected with and sleeved onto the reel shaft 42, thus the cord spool 41 can be driven to rotate when the reel shaft 42 rotates. The two end surfaces of the cord spool 41 are respectively provided with protruding rotating rings. The protruding rotating rings are annular in shape, and the protruding rotating rings correspond to the respective rotating grooves 34 on a one-to-one basis, the two rotating rings are respectively embedded in the corresponding rotating grooves 34 to form a rotating fit. Both ends of the reel shaft 42 extend beyond the cord spool 41, with one end of the reel shaft 42 being inserted in the through hole 321 and allowing to be connected to a reel handle located outside the reel housing 3, while the other end of the reel shaft 42 being inserted in the blind hole. The reel shaft 42 and the cord spool 41 can be driven to rotate, by rotating the reel handle. The two rotating grooves 34 can function not only to guarantee a stable position of the cord spool assembly 4 in use, but also ensure no random dislocation of the cord spool assembly 4 during maintenance after the first half housing 32 or the second half housing 33 is disassembled, thus making maintenance easy and convenient. In addition, providing the through hole 321 facilitates a user to actuate the rotation of the cord spool assembly 4 from outside the reel housing 3, thus ensuring easy use of the reel mechanism.

One end of the reel shaft 42 inserted into the through hole 321 is sleeved into a metal bushing 44, and the metal bushing 44 is a copper bushing and embedded in the through hole 321, and functions to separate the reel shaft 42 from a hole-wall surface of the through hole 321. The cord spool assembly 4 is provided with a stop structure which functions to prevent the cord spool 41 from spontaneous rotation, the stop structure comprising a stop spring 43 provided between the end of the reel shaft 42 inserted in the blind hole and a corresponding end surface of the cord spool 41, or as an alternative, the stop structure comprising a ratchet structure provided between the reel housing 3 and the cord spool assembly 4. The purpose of providing the stop spring 43 is as follows: after a user controls the cord spool 41 by means of the reel shaft 42 to adjust (i.e. wind/unwind) the cord 9 in place, the stop spring 43 can limit and lock the cord spool 41 to prevent the cord spool 41 from spontaneous rotation, thus avoiding the above adjustment becoming in vain.

Meanwhile, the purpose of providing the metal bushing 44 sleeved onto the end of the reel shaft 42 inserted into the through hole 321 and embedding the metal bushing 44 in the through hole 321 is to reduce wear of the first half housing 32 during rotation of the reel shaft 42, so that only the metal bushing 44 needs to be replaced for later maintenance, thus making maintenance low-cost and convenient.

As shown in FIG. 1, FIGS. 3-6 and FIG. 8, in one embodiment of the present invention, the post 1 comprises a vertically disposed pole 11 and an adjusting mount 12 capable of sliding upward and downward along the pole 11 and positioning on the pole 11, one end of the inclined rod 2 is hinged to the adjusting mount 12, and the inclined rod 2 is capable of swinging upward and downward relative to the adjusting mount 12. Hence, sliding the adjusting mount 12 upward and downward relative to the pole 11 can adjust the inclined rod 2 in angle and height, so as to adjust state of the cantilever parasol, thus ensuring convenient use of the cantilever parasol. Furthermore, the cantilever parasol further comprises a limit pin 8, which can be inserted and fitted in any one of limit slots provided and vertically spaced on the pole 11; thus, when the adjusting mount 12 is adjusted to a specified height position, the limit pin 8 may be controlled to be inserted and matched with a corresponding limit slot on the pole 11, to provide vertical support and position limit for the adjusting mount 12, ensuring a stable position of the adjusting mount 12.

One end portion at one end of the inclined rod 2 is sleeved into a sleeve shell 6, and the sleeve shell 6, the inclined rod 2 and the adjusting mount 12 are coaxially hinged. Specifically, the sleeve shell 6 is disposed in the adjusting mount 12, and one end of the inclined rod 2 is inserted in the sleeve shell 6; an articulating shaft is threaded through respective coaxial holes on first side walls of the adjusting mount 12, the sleeve shell 6 and the inclined rod 2 sequentially, and then threaded through respective coaxial holes on second side walls of the inclined rod 2, the sleeve shell 6 and the adjusting mount 12 sequentially. The sleeve shell 6 can wrap sharp edges of the end of the inclined rod 2, forming a protection for the end of the inclined rod 2 and the adjusting mount 12; the sleeve shell 6, and the inclined rod 2 are coaxially hinged with the adjusting mount 12 through the same articulating shaft, which can reduce influence of assembly tolerances on stability, thereby reducing phenomenon of swaying of the inclined rod 2. Further, two tie rods 7 are hinged between the inclined rod 2 and the post 1, first ends of the two tie rods 7 are respectively located on two sides of a top end of the post 1, and second ends of the two tie rods 7 are respectively located on two sides of a middle section of the inclined rod 2. This configuration provides a more stable structure of the parasol frame while ensuring adjustment function of the inclined rod 2, greatly improving wind resistance of the cantilever parasol.

The specific embodiments described herein are merely illustrative of the spirit of the present invention. Technicians skilled in the art to which the present invention pertains can make various modifications or additions to the specific embodiments described or replace them in a similar manner, without departing from the spirit of the present invention or beyond the scope defined by the appended claims.

REFERENCED PARTS

1 post
11 pole
12 adjusting mount
2 inclined rod
21 cord hole
3 reel housing
31 avoidance notch
311 flange
32 first half housing
321 through hole
33 second half housing
34 rotating groove
4 cord spool assembly
41 cord spool
42 reel shaft
43 stop spring
44 metal bushing
5 cord guide roller
6 sleeve shell
7 tie rod
8 limit pin
9 cord
10 parasol ribs

The invention claimed is:

1. A cantilever parasol, comprising a post and a reel mechanism and an inclined rod capable of supporting parasol ribs, the inclined rod being hollow and allowing a cord to extend along its inner channel, the reel mechanism comprising a reel housing and a cord spool assembly capable of controlling winding and unwinding of the cord, wherein a side wall of the reel housing is provided with an avoidance notch communicated with an inner cavity of the reel housing, one end of the inclined rod is connected with the post, an outer peripheral surface of the inclined rod is provided with a cord hole communicated with the inner channel of the inclined rod, a side portion of the inclined rod is embedded in the avoidance notch, a part of the inclined rod provided with the cord hole is located in the inner cavity of the reel housing, the reel housing and the inclined rod are detachably connected with each other, the cord spool assembly is rotatably installed in the reel housing and located on an outer side of the inclined rod, and the cord is passed through the cord hole and connected with the cord spool assembly; and wherein two tie rods are hinged between the inclined rod and the post, first ends of the two tie rods are respectively located on two sides of a top end of the post, and second ends of the two tie rods are respectively located on two sides of a middle section of the inclined rod.

2. The cantilever parasol as claimed in claim 1, wherein the reel housing comprises a first half housing and a second half housing that are detachably connected, the cord spool assembly is located between the first half housing and the second half housing, the first half housing and the second half housing are snap-fitted together to form the avoidance notch, and the first half housing and the second half housing are respectively detachably connected to two sides of the inclined rod.

3. The cantilever parasol as claimed in claim 2, wherein the cord spool assembly comprises a cord spool capable of winding the cord, a rotatable cord guide roller is provided in and connected to the inner channel of the inclined rod, an axial line of the cord guide roller is parallel to an axial line of the cord spool, and the cord hole is located between the cord guide roller and the cord spool.

4. The cantilever parasol as claimed in claim 3, wherein the first half housing has a first rotating groove and the second half housing has a second rotating groove, the two rotating grooves are coaxially and directly facing each other, and two ends of the cord spool assembly are respectively rotatably fitted in the two rotating grooves.

5. The cantilever parasol as claimed in claim 4, wherein the cord spool assembly further comprises a reel shaft capable of driving the cord spool to rotate, the cord spool is coaxially sleeved onto the reel shaft, a bottom of the first rotating groove on the first half housing is provided with a through hole penetrating through a housing wall of the first half housing, the through hole and the first rotating groove are arranged coaxially, and one end of the reel shaft is inserted into the through hole.

6. The cantilever parasol as claimed in claim 5, wherein one end of the reel shaft inserted into the through hole is sleeved into a metal bushing, and the metal bushing is embedded in the through hole.

7. The cantilever parasol as claimed in claim 1, wherein the post comprises a vertically disposed pole and an adjusting mount capable of sliding upward and downward along the pole and positioning on the pole, one end of the inclined rod is hinged to the adjusting mount, and the inclined rod is capable of swinging upward and downward relative to the adjusting mount.

8. The cantilever parasol as claimed in claim 7, wherein one end portion at one end of the inclined rod is sleeved into a sleeve shell, and the sleeve shell, the inclined rod and the adjusting mount are coaxially hinged.

9. The cantilever parasol as claimed in claim 1, wherein a rim of the avoidance notch is provided with a flange capable of limiting the inclined rod from falling out of the avoidance notch, and the flange protrudes toward an inner side of the avoidance notch.

* * * * *